United States Patent [19]

Hundertmark et al.

[11] Patent Number: 4,776,302

[45] Date of Patent: Oct. 11, 1988

[54] TWO CYCLE ENGINE WITH EXHAUST BRIDGE LUBRICATION

[75] Inventors: James M. Hundertmark, Fond du Lac; James C. Schuenke, Oshkosh, both of Wis.

[73] Assignee: Brunswick Corporation, Skokie, Ill.

[21] Appl. No.: 133,313

[22] Filed: Dec. 16, 1987

[51] Int. Cl.[4] ..... F01P 1/04

[52] U.S. Cl. ..... 123/41.39; 123/73 PP

[58] Field of Search ..... 123/73 PP, 543, 546, 123/668, 41.33, 41.3, 41.39, 41.79, 41.78, 41.84

[56] References Cited

U.S. PATENT DOCUMENTS

| | | | |
|---|---|---|---|
| 2,085,810 | 7/1937 | Ljungstrom | 123/41.32 |
| 3,127,879 | 4/1964 | Giacosa et al. | 123/41.08 |
| 3,687,232 | 8/1972 | Stenger | 184/6.8 |
| 3,714,931 | 2/1973 | Neitz et al. | 123/41.79 |
| 3,881,454 | 5/1975 | Jaulmes | 123/73 PP |
| 4,348,991 | 9/1982 | Stang et al. | 123/41.44 |
| 4,440,118 | 4/1984 | Stang et al. | 123/41.84 |
| 4,557,227 | 12/1985 | Woodard | 123/65 PE |

*Primary Examiner*—Charles J. Myhre
*Assistant Examiner*—David A. Okonsky
*Attorney, Agent, or Firm*—Andrus, Sceales, Starke & Sawall

[57] ABSTRACT

In a two cycle internal combustion engine (2), a fuel-air flow passage and reservoir (52) is provided along the exhaust bridge (34) and between the piston (4) and the cylinder inner wall (36) for lubricating the exhaust bridge (34). The piston (4) has a flat spot (50) machined on its side wall (38) to form an axially extending flow passage and reservoir closed at its top end by the piston rings (40) and at its bottom end by a lower portion (60) of the piston side wall (38) which is not machined and which is closely adjacent the cylinder inner wall (36). When the piston (4) is in its power stroke, crankcase pressure forces fuel-air mixture through holes (56, 58) in the piston side wall (38) at the flat surface (50) into the flow passage and reservoir (52). If the exhaust bridge (34) heats and expands into the cylinder (6), the piston (4) will not rub on it.

8 Claims, 2 Drawing Sheets

TWO CYCLE ENGINE WITH EXHAUST BRIDGE LUBRICATION

BACKGROUND AND SUMMARY

The invention relates to two cycle engines with an exhaust port bridge.

In a two cycle internal combustion engine, it is known to provide an exhaust port with two openings through the cylinder wall, and with a bridge between the openings to prevent expansion of the piston rings into the exhaust port. However, when the bridge becomes heated it may expand into the cylinder which in turn interfers with the piston and causes heavy loading of the piston. One solution known in the prior art is to relieve the bridge. It is also known in the prior art to provide holes in the piston side wall for lubricating the bridge.

The present invention solves the above noted problem without relieving the bridge. A fuel-air flow passage is provided along the exhaust bridge, and a reservoir is provided between the piston and the cylinder inner wall to improve lubrication of the exhaust bridge.

DETAILED DESCRIPTION

Figure 1:
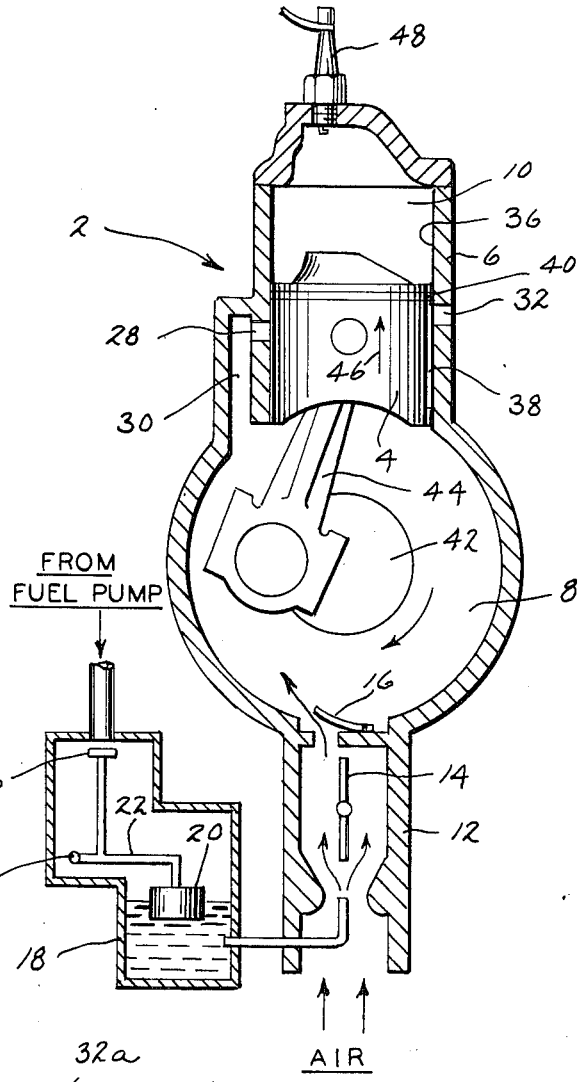
FIG. 1 is a schematic illustration of a two cycle internal combustion engine.
Figure 2:
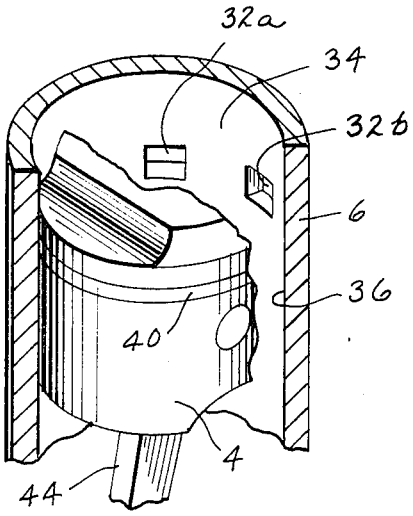
FIG. 2 is a perspective view of a portion of the engine of FIG. 1 showing the exhaust port with a pair of openings and a bridge therebetween.

FIG. 1 shows one cylinder of a two cycle crankcase compression internal combustion engine 2. A piston 4 is reciprocal in a cylinder 6 between a crankcase 8 and a combustion chamber 10. A carburetor 12 supplies fuel and air as controlled by throttle valve 14 into crankcase 8 through one-way reed valve 16. The carburetor includes a float bowl 18 having a float 20 connected to lever 22 pivoted at 24 to open or close valve 26 to admit or block fuel from the fuel pump, all as is known. There is a fuel-air inlet port 28 in combustion chamber 10. A fuel-air transfer passage 30 extends between crankcase 8 and fuel-air inlet port 28. Exhaust port mean 32 in the combustion chamber is provided by a pair of openings 32*a* and 32*b*, FIG. 2, through the cylinder wall, and an exhaust bridge 34 between the openings. Piston 4 has an outer cylindrical side wall 38 of given radius closely adjacent cylinder inner wall 36. Piston 4 has one or more rings 40 engaging cylinder inner wall 36. Bridge 34 prevents expansion of piston rings 40 into the exhaust port. Piston 4 is connected to crankshaft 42 by connecting rod 44.

In operation piston 4 has a charging stroke in the upward axial direction shown at arrow 46 compressing fuel-air mixture in combustion chamber 10 and creating a vacuum in crankcase 8. Piston 4 has a power stroke upon combustion of the mixture by spark plug 48 driving piston 4 downwardly in the opposite axial direction pressurizing crankcase 8 and forcing fuel-air mixture to flow from crankcase 8 through transfer passage 30 to fuel-air inlet port 28 in combustion chamber 10 for repetition of the cycle. The spent combustion products are exhausted through exhaust port openings 32*a* and 32*b*. The engine construction and operation described thus far is conventional.

Figure 3:
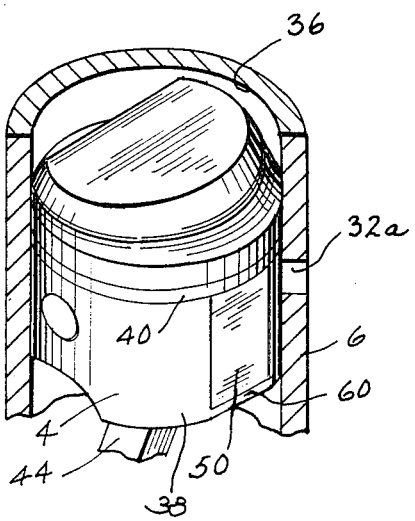
FIG. 3 is a perspective view of a portion of an engine constructed in accordance with the invention.
Figure 4:
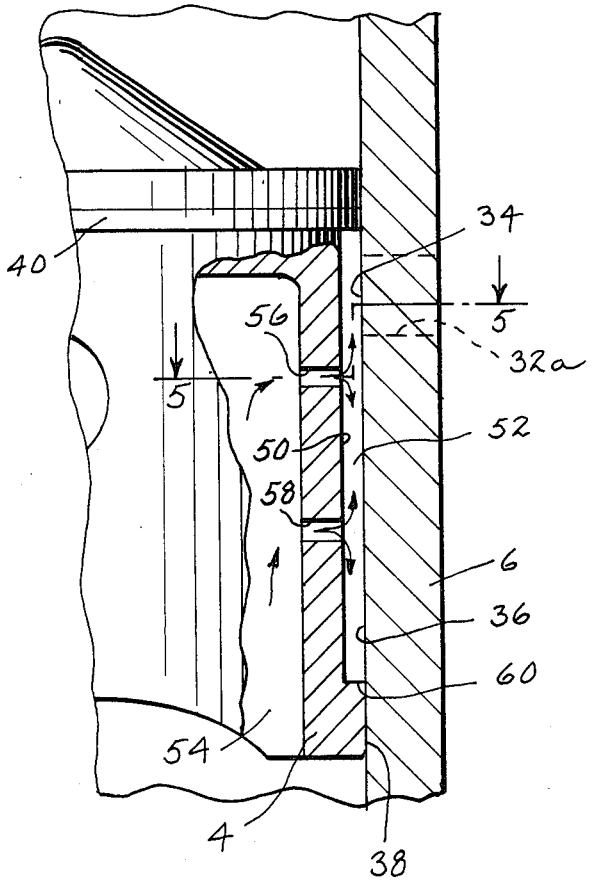
FIG. 4 is a sectional view of a portion of the structure in FIG. 3.
Figure 5:
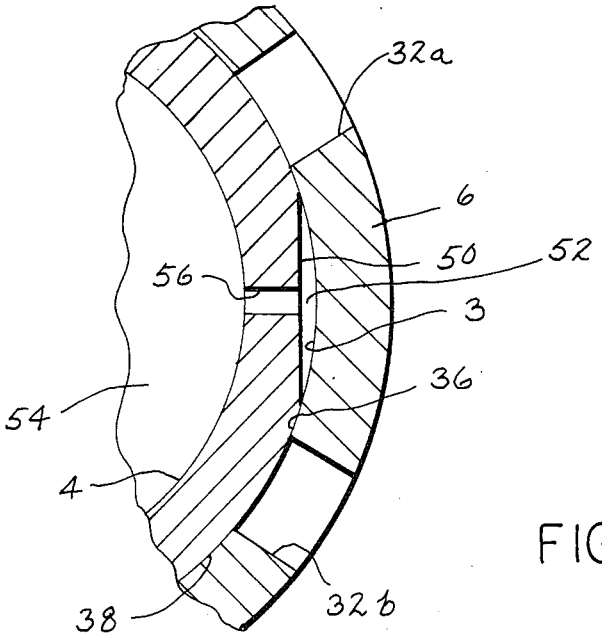
FIG. 5 is a sectional view taken along line 5—5 of FIG. 4.

In the present invention, piston 4 has the noted cylindrical outer side wall 38 of given radius closely adjacent cylinder inner wall 36 except for a relieved surface 50, FIGS. 3–5, preferably a flat surface, on piston outer side wall 38. Flat surface 50 is spaced from cylinder inner wall 36 and forms an axially extending flow passage gap 52, FIGS. 4 and 5, between relieved flat surface 50 of piston outer side wall 38 and cylinder inner wall 36.

Piston 4 has a hollow interior 54 communicating with crankcase 8. Apertures 56 and 58 through the piston outer side wall 38 at flat surface 50 communicate the interior 54 of the piston with the axially extending flow passage gap 52. During the power stroke of the piston, fuel-air mixture in crankcase 8 is forced through apertures 56 and 58 as shown by the arrows in FIG. 4 and into flow passage gap 52 to lubricate exhaust bridge 34.

Exhaust bridge 34 is a portion of the inner wall 36 of the cylinder between and bridging exhaust port openings 32*a* and 32*b*. Flow passage gap 52 extends axially along exhaust bridge portion 34 of the cylinder inner wall 36 and communicates with exhaust bridge portion 34 of the cylinder inner wall but not with exhaust port openings 32*a* and 32*b*, as shown in FIG. 5.

Apertures 56 and 58 communicate fuel-air mixture from the crankcase to exhaust bridge 34 to lubricate the latter. Gap 52 provides a fuel-air flow passage and reservoir between piston 4 and cylinder inner wall 36 to facilitate flow to exhaust bridge 34 to improve lubrication of the latter. Apertures 56 and 58 extend radially through the side wall of the piston. Gap 52 has a top axial end closed by piston rings 40. Gap 52 has a lower axial end closed by a portion 60, FIG. 4, of the piston side wall which is not relieved and which has the noted given radius to be closely adjacent cylinder inner wall 36. Piston 4 is thus spaced from cylinder inner wall 36 by a small tolerance gap except for the axially extending gap 52 which spaces apertures 56 and 58 from exhaust bridge 34 by a larger gap to form the fuel-air flow passage and reservoir 52 and improve lubrication of exhaust bridge 34. The flow in passage 52 leaks back into the crankcase along the interface between inner cylinder wall 36 and piston side wall 38 including lower portion 60.

Flat surface 50 on piston 4 enables expansion of bridge 34 into the cylinder when heated without rubbing on the piston. Furthermore, when piston 4 has lubricating holes 56 and 58 therethrough, such holes are never sealed off, and hence when the piston is in its downward power stroke, crankcase pressure forces fuel mixture onto the bridge to lubricate it for the piston rings sliding therepast. Flat surface 50 is preferably machined on the side wall of the piston, and holes 56 and 58 are preferably drilled through the piston side wall at flat surface 50. It is preferred that flat surface 50 not be machined all the way to the bottom of the piston, but only to lower skirt 60 so as to not to cause excess crankcase leakage and to afford the noted reservoir and fuel-air flow passage 52.

It is recognized that various equivalents, alternatives and modifications are possible within the scope of the appended claims.

We claim:

1. A two cycle internal combustion engine comprising:

a piston reciprocal in a cylinder between a crankcase and a combustion chamber, said cylinder having an inner wall, said piston having one or more rings engaging said cylinder inner wall;

means for supplying fuel and air to said crankcase;

fuel-air inlet port means in said combustion chamber;

fuel-air transfer passage means between said crankcase and said fuel-air inlet port means in said combustion chamber;

exhaust port means in said combustion chamber, and exhaust bridge means in said exhaust port means preventing expansion of said piston rings into said exhaust port means;

said piston having a charging stroke in one axial direction compressing fuel-air mixture in said combustion chamber and creating a vacuum in said crankcase, and having a power stroke upon combustion of said mixture driving said piston in the opposite axial direction pressurizing said crankcase and forcing fuel-air mixture to flow from said crankcase through said transfer passage means to said fuel-air inlet port means in said combustion chamber for repetition of the cycle, the spent combustion products being exhausted through said exhaust port means;

means providing a fuel-air flow passage along said exhaust bridge means and between said piston and said cylinder inner wall for lubricating said exhaust bridge means.

2. A two cycle internal combustion engine comprising:

a piston reciprocal in a cylinder between a crankcase and a combustion chamber, said cylinder having an inner wall, said piston having one or more rings engaging said cylinder inner wall;

means for supplying fuel and air to said crankcase;

fuel-air inlet port means in said combustion chamber;

fuel-air transfer passage means between said crankcase and said fuel-air inlet port means in said combustion chamber;

exhaust port means in said combustion chamber, and exhaust bridge means in said exhaust port means preventing expansion of said piston rings into said exhaust port means;

said piston having a charging stroke in one axial direction compressing fuel-air mixture in said combustion chamber and creating a vacuum in said crankcase, and having a power stroke upon combustion of said mixture driving said piston in the opposite axial direction pressurizing said crankcase and forcing fuel-air mixture to flow from said crankcase through said transfer passage means to said fuel-air inlet port means in said combustion chamber for repetition of the cycle, the spent combustion products being exhausted through said exhaust port means;

means communicating fuel-air mixture from said crankcase to said exhaust bridge means to lubricate the latter;

means providing a fuel-air flow passage and reservoir between said piston and said cylinder inner wall to facilitate fuel-air mixture flow to said exhaust bridge means to improve lubrication of the latter.

3. The invention according to claim 2 wherein:

said means communicating fuel-air mixture from said crankcase to said exhaust bridge means comprises one or more apertures extending radially through a side wall of said piston;

said means providing a fuel-air flow passage and reservoir between said piston and said cylinder inner wall comprises an axially extending gap spacing said piston from said inner wall.

4. The invention according to claim 3 wherein said piston is spaced from said cylinder inner wall by a small tolerance gap except for said axially extending gap which spaces said one or more apertures in said piston side wall from said exhaust bridge means by a substantially larger gap forming said fuel-air flow passage and reservoir and improving lubrication of said exhaust bridge means.

5. A two cycle internal combustion engine comprising:

a piston reciprocal in a cylinder between a crankcase and a combustion chamber, said cylinder having an inner wall, said piston having one or more rings engaging said cylinder inner wall;

means for supplying fuel and air to said crankcase;

fuel-air inlet port means in said combustion chamber;

fuel-air transfer passage means between said crankcase and said fuel-air inlet port means in said combustion chamber;

exhaust port means in said combustion chamber, and exhaust bridge means in said exhaust port means preventing expansion of said piston rings into said exhaust port means;

said piston having a charging stroke in one axial direction compressing fuel-air mixture in said combustion chamber and creating a vacuum in said crankcase, and having a power stroke upon combustion of said mixture driving said piston in the opposite axial direction pressurizing said crankcase and forcing fuel-air mixture to flow from said crankcase through said transfer passage means to said fuel-air inlet port means in said combustion chamber for repetition of the cycle, the spent combustion products being exhausted through said exhaust port means;

said piston having a cylinder outer side wall of given radius closely adjacent said cylinder inner wall except for a relieved surface on said piston outer side wall extending axially therealong and facing said exhaust bridge means and spaced from said cylinder inner wall and forming an axially extending flow passage gap between said relieved surface of said piston outer side wall and said cylinder inner wall;

said piston having a hollow interior communicating with said crankcase, and comprising one or more apertures through said piston side wall communicating the interior of said piston with said axially extending flow passage gap between said relieved surface of said piston outer side wall and said cylinder inner wall, such that during said power stroke, fuel-air mixture in said crankcase is forced through said one or more apertures in said piston side wall and into said axially extending flow passage gap to lubricate said exhaust bridge means.

6. The invention according to claim 5 wherein said exhaust port means comprises a pair of openings in said cylinder, and wherein said exhaust bridge means comprises a portion of said inner wall of said cylinder between and bridging said openings, and wherein said flow passage gap extends axially along said exhaust bridge portion of said cylinder inner wall and communicates with said exhaust bridge portion of said cylinder inner wall but not with said exhaust port openings.

7. The invention according to claim 6 wherein said gap has one axial end closed by said one or more piston rings engaging said cylinder inner wall, and has the other axial end closed by a portion of said piston wall which is not relieved and which has said given radius.

8. The invention according to claim 7 wherein said relieved surface is flat.

* * * * *